United States Patent [19]

Lockard

[11] 3,934,105

[45] Jan. 20, 1976

[54] MINIATURE SWITCH WITH LIGHTED INDICATOR

[75] Inventor: Joseph Larue Lockard, Harrisburg, Pa.

[73] Assignee: AMP Incorporated, Harrisburg, Pa.

[22] Filed: Jan. 13, 1975

[21] Appl. No.: 540,784

Related U.S. Application Data

[63] Continuation of Ser. No. 468,321, May 9, 1974, abandoned.

[52] U.S. Cl. ..... 200/317; 200/5 A; 240/2 S

[51] Int. Cl.[2] ..... H01H 3/12

[58] Field of Search ..... 200/5 A, 5 D, 159 A, 246, 200/275, 310, 317; 240/2 S; 116/DIG. 28

[56] References Cited

UNITED STATES PATENTS

| | | | |
|---|---|---|---|
| 3,179,777 | 4/1965 | Rohacs | 200/317 |
| 3,286,055 | 11/1966 | Jewell | 200/317 |
| 3,842,230 | 10/1974 | Kashio | 200/5 A |
| 3,858,019 | 12/1974 | Muri | 200/5 A |

*Primary Examiner*—Gerald P. Tolin
*Attorney, Agent, or Firm*—Gerald K. Kita

[57] ABSTRACT

A miniature momentary push button switch includes a light emitting diode mounted in a dual-in-line package having rows of electrical leads for pluggable connection in a printed circuit board. The electrical leads provide an interruptible circuit path through the package and are fabricated from a standard lead frame. The circuit is normally open and is momentarity closed by manual actuation of a push button. For ease in manufacture, the interruptible circuit path is not electrically connected to the diode within the package. Instead the depending electrical leads are capable of pluggable connection to a circuit means which connects the diode electrically in series with the interruptible portion of the circuit by any one of a variety of techniques.

3 Claims, 4 Drawing Figures

MINIATURE SWITCH WITH LIGHTED INDICATOR

This is a continuation of application Ser. No. 468,321, filed May 9, 1974, and now abandoned.

BACKGROUND OF THE PRIOR ART

With the advent of circuit miniaturization in the form of solid state circuit elements, there has been a long existing need for a go, no-go indicator of miniature size which can be incorporated on a printed circuit board together with the circuit elements. Such an indicator is utilized to check the electrical continuity of the circuit elements and the circuit incorporating the circuit elements. Also the indicator is used to precisely locate in the circuit a malfunctioning element. The present invention incorporates a momentary push button switch of miniature size and in the form of a dual-in-line package for mounting directly to the printed circuit board as one of the passive circuit elements. Electrical leads in the dual-in-line package provide an interruptible circuit portion contained within the package which is momentarily closed by actuating a push button to light a low power illumination device such as a light emitting diode (led) as an indication of circuit continuity. For ease in manufacture, the led and push button are mounted in a cover portion of the package, and the contacts or leads are assembled onto a base portion which mates with the cover. The inerruptible circuit is electrically isolated within the package from the led, eliminating the need for internal bridging circuitry therebetween. Instead the leads of the package project from the base portion for pluggable connection to external circuitry which is used to connect the interruptible circuit portion with the led. Such a feature allows for ease in manufacturing the interruptible circuit portion as a standard lead frame without a need for interconnecting circuitry within the package.

OBJECTS OF THE INVENTION

It is accordingly an object of the present invention to provide a dual-in-line package switch with a light emitting circuit element and an interruptible circuit portion actuated by a push button, with depending leads of the package adpated for pluggable connection to electrical circuitry which connects the lightable circuit element with the interruptible circuit portion electrically in series externally of the package.

Another object of the present invention is to provide a dual-in-line package wherein the electrical leads thereof are arranged in opposed rows with a first pair of opposed leads being connected electrically to a light emitting diode and a second pair of leads forming an interruptible circuit portion momentarily connected upon actuation of a push button, the led and a push button being mounted in a cover portion separate from the base.

Other objects and many attendant advantages of the present invention will be become apparent upon perusal of the following detailed description taken in conjunction with the accompanying drawings.

DETAILED DESCRIPTION

Figure 1:
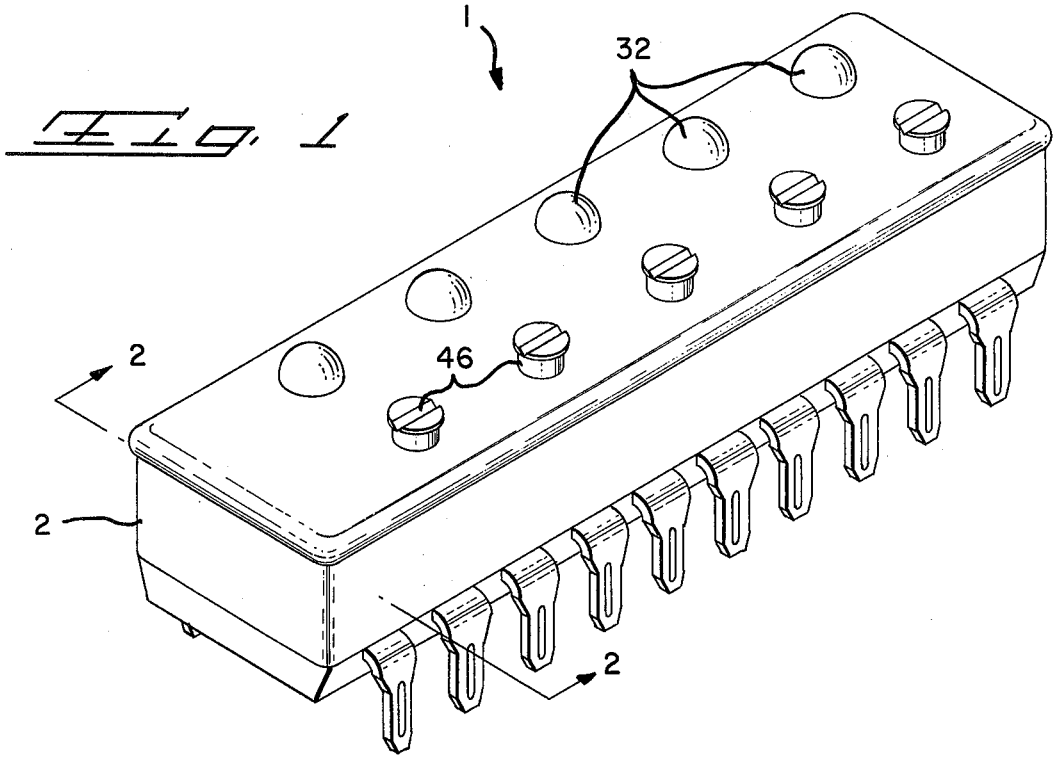
FIG. 1 is an enlarged perspective of a dual-in-line package containing a momentary contact switch array and light emitting diode array according to the present invention.
Figure 2:
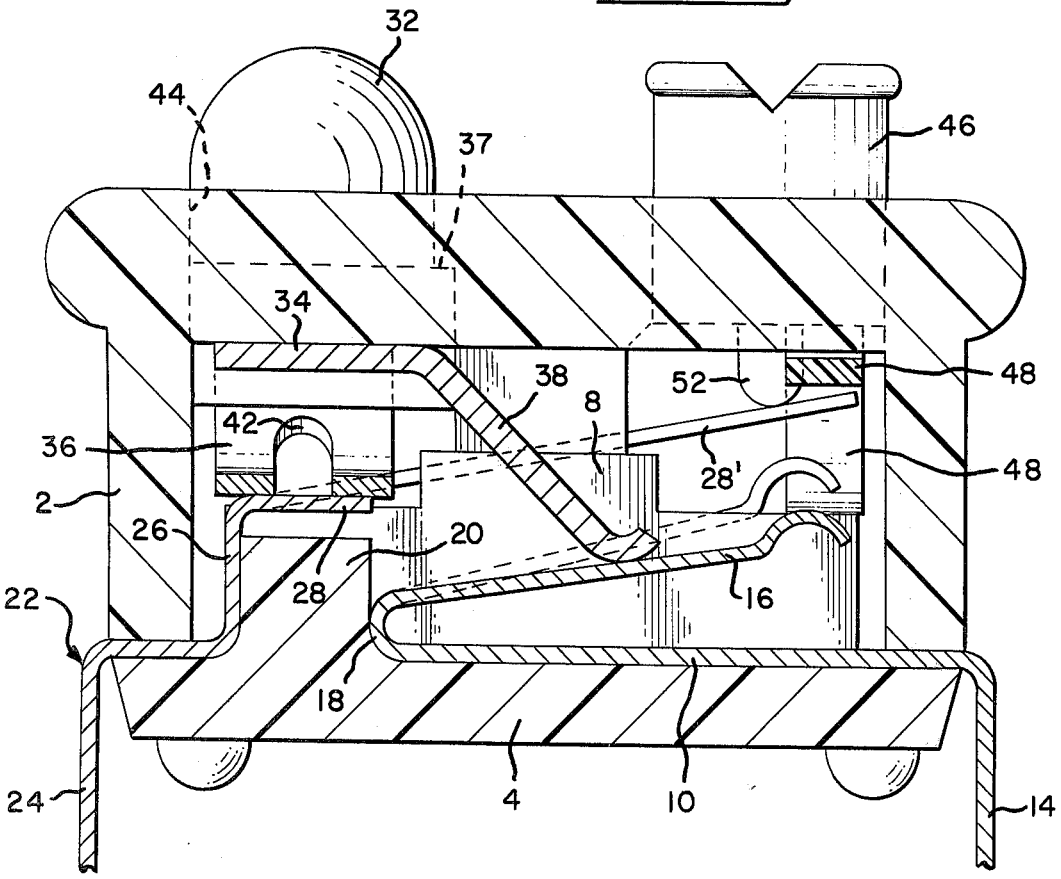
FIG. 2 is an enlarged section taken along the line 2—2 in FIG. 1.
Figure 3:
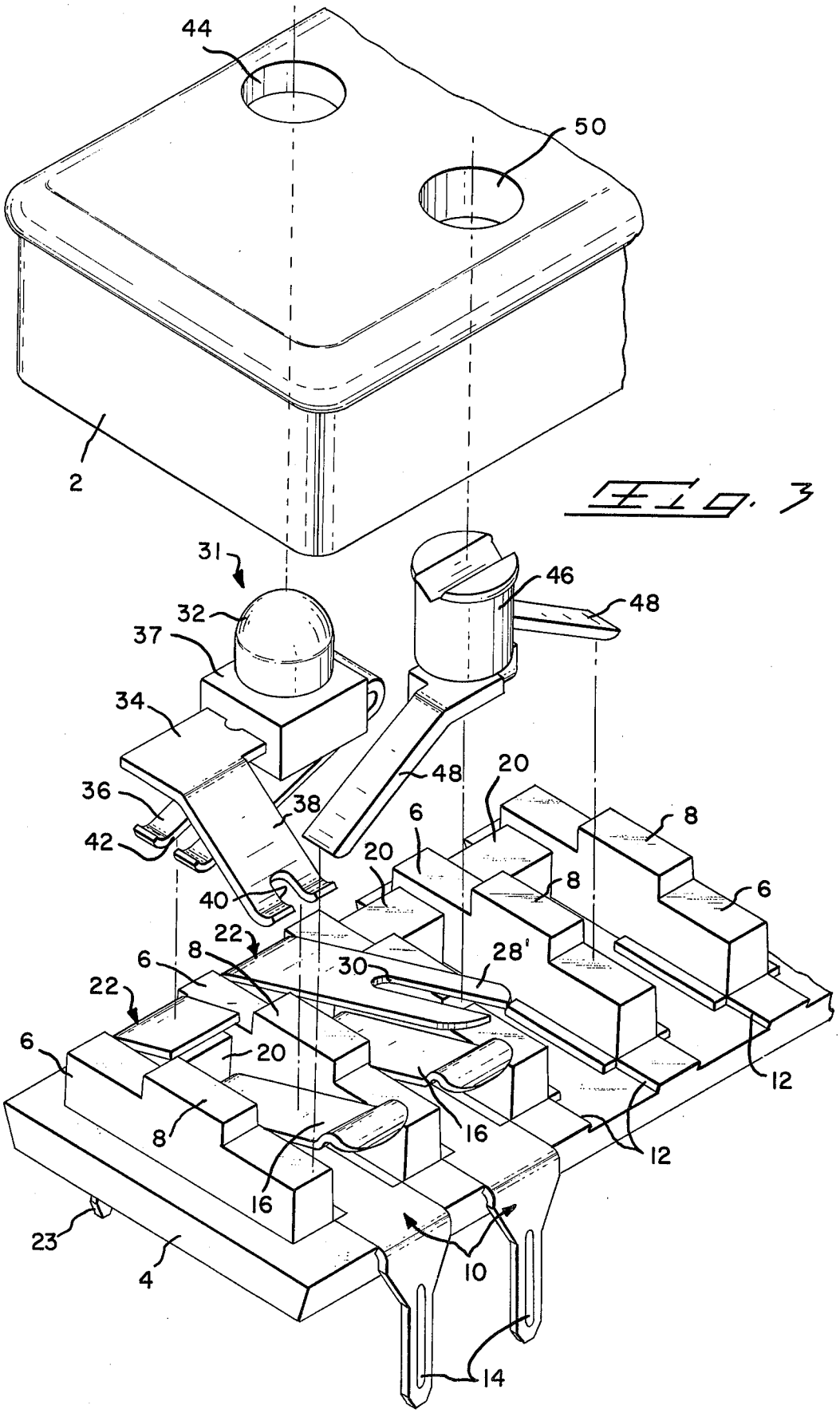
FIG. 3 is an enlarged fragmentary exploded perspective illustrating the component parts of the present invention.

With more particular reference to FIGS. 1, 2, and 3, there is illustrated generally at 1 a dual-in-line package according to the present invention including a generally inverted rectangular cover 2 generally of box-like configuration. The invention further includes a base portion 4 which has a plurality of parallel spaced paritions 6 each of which has a stepped projecting central portion 8. In the spaces between the partitions are provided a corresponding plurality of electrical leads 10 arranged in a first row. The leads 10 are elongated leaf spring contacts having the central portions thereof disposed incorresponding grooves, some of which are shown at 12 in the surface of the base portion 4. As shown the grooves 12 are of stepped rectangular or otherwise irregular shape allowing the leads 10 to be fabricated with complimentary shapes for latching retention in position within the corresponding grooves 12. First end portions 14 of the row of leads 10 are formed into depending relationship and are tapered to form relatively narrow projecting external leads for pluggable connection externally of the dual-in-line package. The leads 10 are doubled back on themselves with the other end portions 16 thereof being projecting angularly outward in spaced relationship from the base portion 4 for location within the space between the projecting partitions 8. The arcuate portion 18 of the doubled back leads are in registration against an upright projecting portion 20, of the base portion, which further serves to locate or position the corresponding leads 10 in desired position on the base portion 4. A second row of electrical leads 22 have depending end portions 24, which are similar in configuration to the end portions 14 of leads 10, to provide leads for pluggable connection externally of the dual-in-line package. The leads 22 are formed to overlie and conform to the intersection of the base portion 4 and the corresponding projection 20. Such a portion 26 further extends above a corresponding projection 20 to provide a resiliently deflectable end portion 28 overlying in spaced relationship the corresponding projection 20. As shown in FIG. 3, each one of the leads 22 includes a portion 28′ which projects outwardly at an angle to overlie in spaced relationship a corresponding opposed lead 16. The terminal end of the lead portion 28′ is bifurcated by a notch 30. Accordingly the base portion 4 has mounted thereto rows of electrical leads arranged in opposed pairs. The leads which are bifurcated alternate with leads which are of relatively short length to overlie corresponding projections 20 of the base portion.

A typical diode assembly is shown more particularly in FIGS. 2 and 3. A transparent semispherical encapsulent material 32 is provided with a light emitting diode imbedded therein according to a well-known practice in the prior art. The diode typically has two electrical leads, one of which is connected to a first stamped and formed contact 34. The other diode lead is electrically connected to another stamped and formed contact 36.

The contacts 34 and 36 are encapsulated within a block 37 of thermosetting plastic material. The contact 34 has a depending leg portion 38 which is bifurcated at 40. The contact portion 36 is doubled back on itself and has the terminal end thereof bifurcated at 42. The cover 2 is provided with a row of apertures 44 complementary in shape with the thermosetting block 38 and the circumference of the transparent material 32, permitting a row of light emitting diode assemblies as described to be mounted within the cover. When the cover is assembled on the base 4 as shown, the contact portion 38 will resiliently impinge against the lead portion 16, and the contact 36 will impinge against the lead portion 28 thereby connecting an individual diode electrically in bridging relationship between corresponding opposed pairs of contacts.

Also as shown in FIG. 3, a molded cylindrical knob or push button 46 of plastic material is provided with integral resilient fingers 48 which project in opposite directions diagonally outward. The cover 2 is provided with a row of apertures 50 which receive the corresponding knobs or buttons 46 therein, thereby mounting the push buttons in the cover 2. The fingers 48 of each button project diagonally outward from the cover and initially engage corresponding partitions 8, serving to continuously bias resiliently the buttons to protrude from the cover 2. Each button 46 is provided with a depending knob 52 for impingement against a corresponding contact portion 28' when the cover is assembled to the base portion 4 as shown in FIG. 2.

Figure 4:
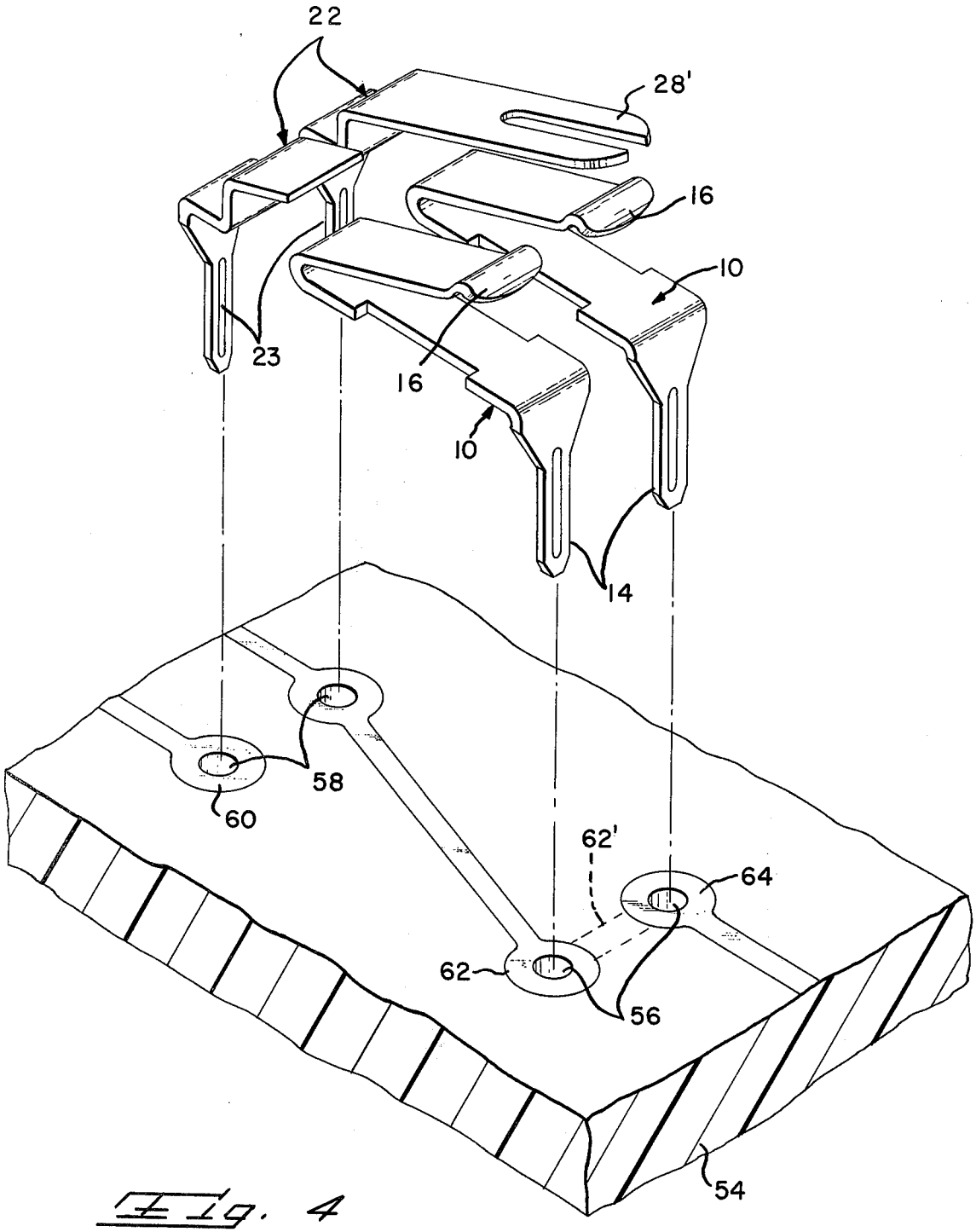
FIG. 4 is a fragmentary enlarged perspective in exploded configuration illustrating exemplary electrical circuitry for use in conjunction with the dual-in-line package according to the present invention.

As shown in FIG. 4, an examplary printed circuit board 54 is provided with a first row of apertures 56 into which the terminal leads 14 are to be pluggably connected. A second row of terminal 58 pluggably receive the terminal leads 23 therein. The printed circuit board is provided with a first circuit path 60 communicating with one of the apartures 58. A second circuit path 62 communicates between one of the apertures 56 and the other of the apertures 58. A circuit path 64 communicates with the other one of the apertures 56. The first opposed pair of contacts connects the diode assembly 31 between the circuit paths 60 and 62. The second opposed pair of contacts comprises an interruptible circuit portion which is connected electrically between the circuit paths 62 and 64. The circuit path 62 provided on the printed circuit board 54 connects electrically in series the diode assembly 31 and the interruptible circuit portion, such that as the illustrated push button 46 is manually displaced toward the base portion, the knob 52 will engage and resiliently deflect the lead portion 28' into electrical engagement on the lead portion 16, thereby completing an electrical circuit through the diode assembly 31, and thereby enabling the diode to light as an indication of circuit continuity.

The resilient fingers 48 as well as the inherent resiliency in the leads 28' automatically separate the lead portions 28' and 16 to interrupt the circuit. The resilient fingers 48 resilient project the push button 46 in return displacement to project externally of the cover 2. Accordingly a momentary lighting of the diode is accomplished serving as an indicator of circuit continuity. As shown in the figure, the leads or contacts are electrically isolated in opposed pairs. The external circuit 62 is relied upon to interconnect electrically between corresponding pairs of leads, thereby eliminating the need for assembling such a connection internally of the dual-in-line package. By eliminating such interconnection circuitry, the electrical leads 10 and 22 may be stamped and formed in rows and merely assembled in position without requiring the expense and time consuming need for interconnection between corresponding opposed pairs of leads. Additionally the circuit paths 62 may have an alternative configuration as shown at 62' in FIG. 4. Accordingly the use of external electrical circuit means to complete the interconnection between the opposed pairs of leads of the package allows greater versatility in circuit path selection as well as eliminates the need for complexity in manufacture of the package according to the present invention.

Although preferred embodiments and modifications of the invention are illustrated and described in detail other embodiments and modifications are intended to be covered in the scope of the apended claims.

What is claimed is:

1. A momentary optical signal switch, for plugging into a printed circuit board, comprising:

a base, a cover on said base, a plurality of electrical contacts mounted in opposed rows along said base, light emitting diodes having pairs of resilient electrical leads, said diodes being mounted in rows in said cover, said pairs of leads resiliently bridging across and engaging first corresponding opposed pairs of said contacts, an array of push buttons mounted in rows in said cover and having corresponding pairs of resilient fingers engaged on said base for resiliently biasing said push buttons to project outwardly from said cover, said push buttons overlying second corresponding opposed pairs of said contacts and momentarily connecting second corresponding opposed pairs of contacts upon displacement of said pushbuttons toward said base, and said rows of contacts projecting from said base for pluggable connection to electrical circuit means to enable bridging one of said first opposed pairs of contacts in series with one of said second opposed pairs of contacts, thereby to complete an electrical circuit through a corresponding diode as a corresponding push button is displaced to momentarily connect a second corresponding opposed pair of contacts.

2. The structure as recited in claim 1, wherein said push buttons include integral resilient fingers, said fingers resiliently biasing said button into protruding relationship from said cover.

3. A momentary optical signal switch for plugging into a printed circuit board, comprising:

a base, a cover on said base, a plurality of electrical contacts mounted in opposed rows along said base, light emitting diodes mounted in said cover and having pairs of electrical leads engaging first corresponding opposed pairs of said contacts, an array of movable switch means projecting from said cover and overlying second corresponding opposed pairs of said contacts, each said switch means being movable toward and connecting momentarily a circuit path between a second corresponding opposed pair of contacts, and said contacts projecting from said base for pluggable connection to electrical circuit means enable bridging one of said first opposed pairs of contacts in series with one of said second opposed pairs of contacts, thereby to complete an electrical circuit through a corresponding diode as a corresponding switch means is movable to connect momentarily a second corresponding opposed pair of contacts.

* * * * *